US006543630B2

(12) United States Patent
Hope

(10) Patent No.: US 6,543,630 B2
(45) Date of Patent: Apr. 8, 2003

(54) DRYING RACK ATTACHABLE TO A DRYER DOOR

(76) Inventor: Richard Hope, 36 Cypress La., Shirley, NY (US) 11967

( * ) Notice: Subject to any disclaimer, the term of this patent is extended or adjusted under 35 U.S.C. 154(b) by 0 days.

(21) Appl. No.: 09/901,760

(22) Filed: Jul. 10, 2001

(65) Prior Publication Data

US 2003/0010736 A1 Jan. 16, 2003

(51) Int. Cl.[7] ..... A47F 5/00

(52) U.S. Cl. ..... 211/133.5; 211/90.03; 34/133; 248/206.3

(58) Field of Search ..... 211/90.03, 106, 211/133.5, DIG. 1, 90.01; 34/133; 248/206.3

(56) References Cited

U.S. PATENT DOCUMENTS 2,272,524 A * 2/1942 Johnson
3,185,537 A * 5/1965 Wright
3,344,532 A * 10/1967 Bigler
4,091,548 A * 5/1978 Daily
4,511,047 A * 4/1985 Elinsky ..... 211/106 X
4,677,760 A 7/1987 St. Louis ..... 34/90
4,702,016 A 10/1987 Grigsby et al. ..... 34/33
5,078,281 A * 1/1992 Johnson ..... 211/DIG. 1 X
5,348,168 A * 9/1994 Emery ..... 211/106
5,449,076 A * 9/1995 Van Noord
5,519,949 A * 5/1996 Gibson
5,548,904 A * 8/1996 Rood
5,623,769 A 4/1997 Hayden ..... 3/61
6,089,387 A * 7/2000 Varfolomeeva
D442,002 S * 5/2001 Rodack

* cited by examiner

*Primary Examiner*—Robert W. Gibson, Jr.
(74) *Attorney, Agent, or Firm*—Goldstein & Lavas, PC.

(57) ABSTRACT

A drying rack attachable to a dryer door including a rack portion. A pair of suction cups are secured to the rack portion. The pair of suction cups allow the rack portion to be removably coupled with an interior surface of a dryer door of a clothing dryer whereby the rack portion is orthogonally disposed with respect to the dryer. A pair of support stoppers are secured to the rack portion disposed below the pair of suction cups. The pair of support stoppers serve to facilitate support of the rack portion with respect to the dryer door.

4 Claims, 3 Drawing Sheets

DRYING RACK ATTACHABLE TO A DRYER DOOR

BACKGROUND OF THE INVENTION

The present invention relates to a drying rack attachable to a dryer door and more particularly pertains to allowing heavier objects to be dried within a clothing dryer without being tossed about within the clothing dryer.

The use of drying rack devices is known in the prior art. More specifically, drying rack devices heretofore devised and utilized for the purpose of drying shoes and the like are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,702,016 to Gribsby discloses a device for drying shoes in a tumble dryer using a strap assembly mounted with a magnet to the sidewall of the appliance. U.S. Pat. No. 4,677,760 to St. Louis discloses a rack assembly mounted to the door in a cantilever fashion. U.S. Pat. No. 5,623,769 to Hayden discloses a flexible metal sheet holder for engaging the inner surface of a clothes dryer.

While these devices fulfill their respective, particular objective and requirements, the aforementioned patents do not describe a drying rack attachable to a dryer door for allowing heavier objects to be dried within a clothing dryer without being tossed about within the clothing dryer.

In this respect, the drying rack attachable to a dryer door according to the present invention substantially departs from the conventional concepts and designs of the prior art, and in doing so provides an apparatus primarily developed for the purpose of allowing heavier objects to be dried within a clothing dryer without being tossed about within the clothing dryer.

Therefore, it can be appreciated that there exists a continuing need for a new and improved drying rack attachable to a dryer door which can be used for allowing heavier objects to be dried within a clothing dryer without being tossed about within the clothing dryer. In this regard, the present invention substantially fulfills this need.

SUMMARY OF THE INVENTION

In the view of the foregoing disadvantages inherent in the known types of drying rack devices now present in the prior art, the present invention provides an improved drying rack attachable to a dryer door. As such, the general purpose of the present invention, which will be described subsequently in greater detail, is to provide a new and improved drying rack attachable to a dryer door which has all the advantages of the prior art and none of the disadvantages.

To attain this, the present invention essentially comprises a rack portion including a lower wall having a forward end, a rearward end, and opposed sides. The forward end has a short lip extending upwardly therefrom. The rearward end has a back wall extending upwardly therefrom. The back wall has a height at least two times greater than a height of the short lip. The opposed sides have triangular side walls extending upwardly therefrom between the back wall and the short lip. A pair of suction cups are secured to the back wall of the rack portion. The pair of suction cups allow the rack portion to be removably coupled with an interior surface of a dryer door of a clothing dryer whereby the lower wall of the rack portion is orthogonally disposed with respect to the dryer. A pair of support stoppers are secured to the back wall of the rack portion disposed below the pair of suction cups. The pair of support stoppers serve to facilitate a support of the rack portion with respect to the dryer door.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved drying rack attachable to a dryer door which has all the advantages of the prior art drying rack devices and none of the disadvantages.

It is another object of the present invention to provide a new and improved drying rack attachable to a dryer door which may be easily and efficiently manufactured and marketed.

It is a further object of the present invention to provide a new and improved drying rack attachable to a dryer door which is of durable and reliable construction.

An even further object of the present invention is to provide a new and improved drying rack attachable to a dryer door which is susceptible of a low cost of manufacture with regard to both materials and labor, and which accordingly is then susceptible of low prices of sale to the consuming public, thereby making such a drying rack attachable to a dryer door economically available to the buying public.

Even still another object of the present invention is to provide a new and improved drying rack attachable to a dryer door for allowing heavier objects to be dried within a clothing dryer without being tossed about within the clothing dryer.

Lastly, it is an object of the present invention to provide a new and improved drying rack attachable to a dryer door including a rack portion. A pair of suction cups are secured to the rack portion. The pair of suction cups allow the rack portion to be removably coupled with an interior surface of a dryer door of a clothing dryer whereby the rack portion is orthogonally disposed with respect to the dryer. A pair of support stoppers are secured to the rack portion disposed below the pair of suction cups. The pair of support stoppers serve to facilitate support of the rack portion with respect to the dryer door.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
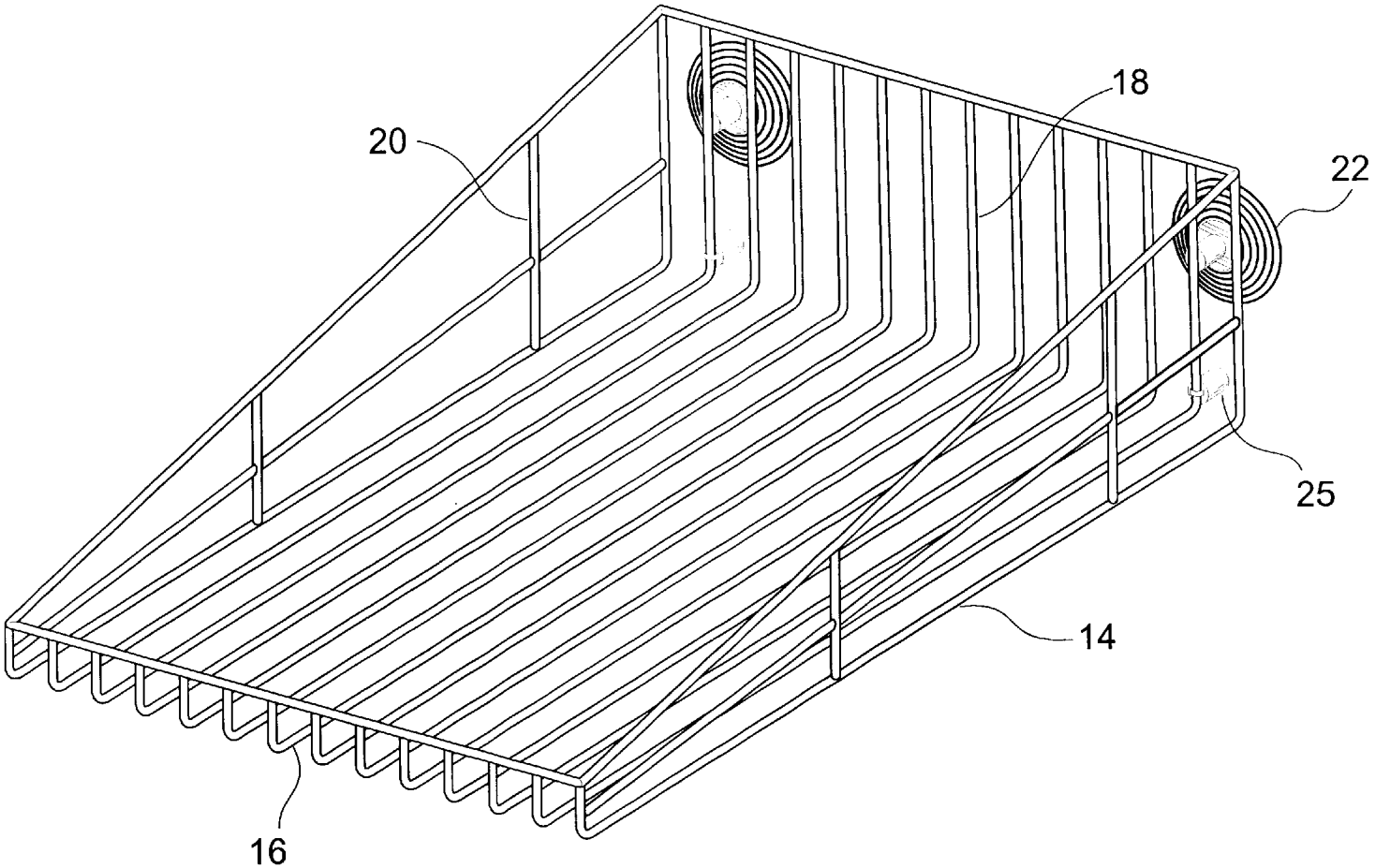
FIG. 1 is a perspective view of the preferred embodiment of the drying rack attachable to a dryer door constructed in accordance with the principles of the present invention.
Figure 2:
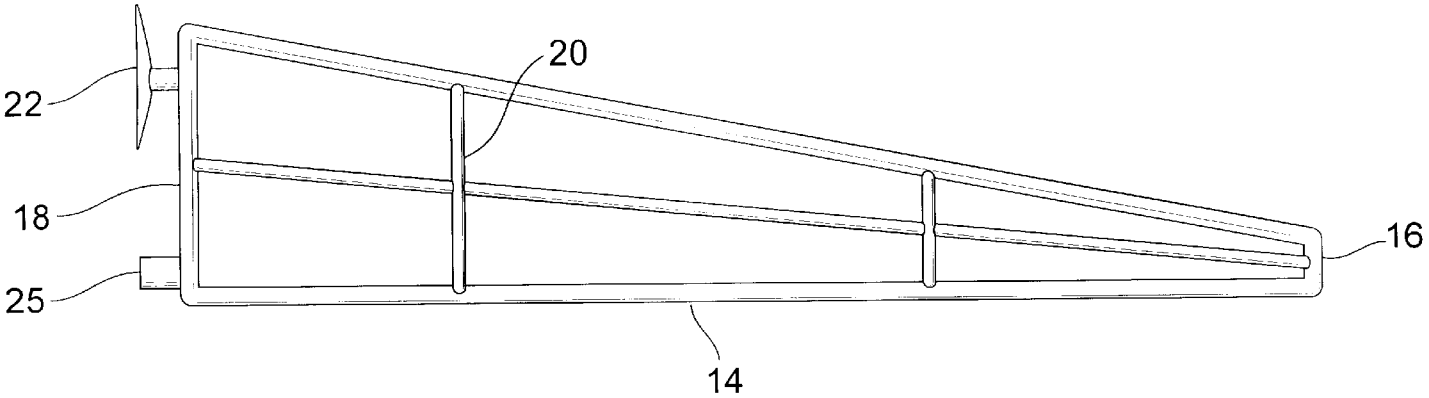
FIG. 2 is a side view of the preferred embodiment of the present invention.

With reference now to the drawings, and in particular, to FIGS. 1 through 4 thereof, the preferred embodiment of the new and improved drying rack attachable to a dryer door embodying the principles and concepts of the present invention and generally designated by the reference number 10 will be described.

Specifically, it will be noted in the various figures that the device relates to a drying rack attachable to a dryer door for allowing heavier objects to be dried within a clothing dryer without being tossed about within the clothing dryer. In its broadest context, the device consists of a rack portion, a pair of suction cups, and a pair of support stoppers. Such components are individually configured and correlated with respect to each other so as to attain the desired objective.

The rack portion 12 includes a lower wall 14 having a forward end, a rearward end, and opposed sides. The forward end has a short lip 16 extending upwardly therefrom. The rearward end has a back wall 18 extending upwardly therefrom. The back wall 18 has a height at least two times greater than a height of the short lip 16. The opposed sides have triangular side walls 20 extending upwardly therefrom between the back wall 18 and the short lip 16.

The pair of suction cups 22 are secured to the back wall 18 of the rack portion 12. The pair of suction cups 22 allow the rack portion 12 to be removably coupled with an interior surface of a dryer door 24 of a clothes dryer 26 whereby the lower wall 14 of the rack portion 12 is orthogonally disposed with respect to the dryer door 24.

The pair of support stoppers 25 are secured to the back wall 18 of the rack portion 12 disposed below the pair of suction cups 22. The pair of support stoppers 25 serve to facilitate a support of the rack portion 12 with respect to the dryer door 24.

Figure 3:
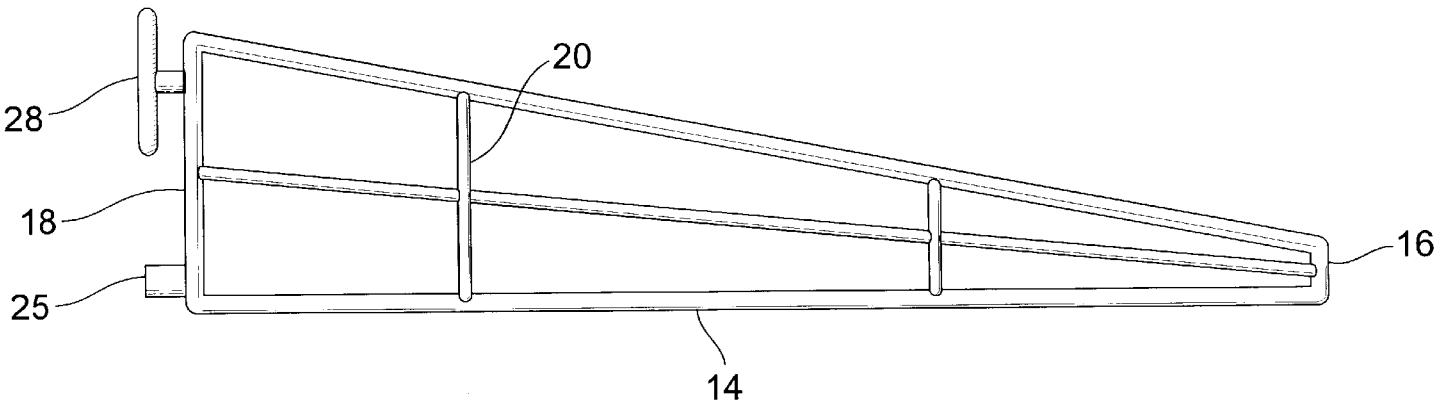
FIG. 3 is a side view of an alternate embodiment of the present invention.
Figure 4:
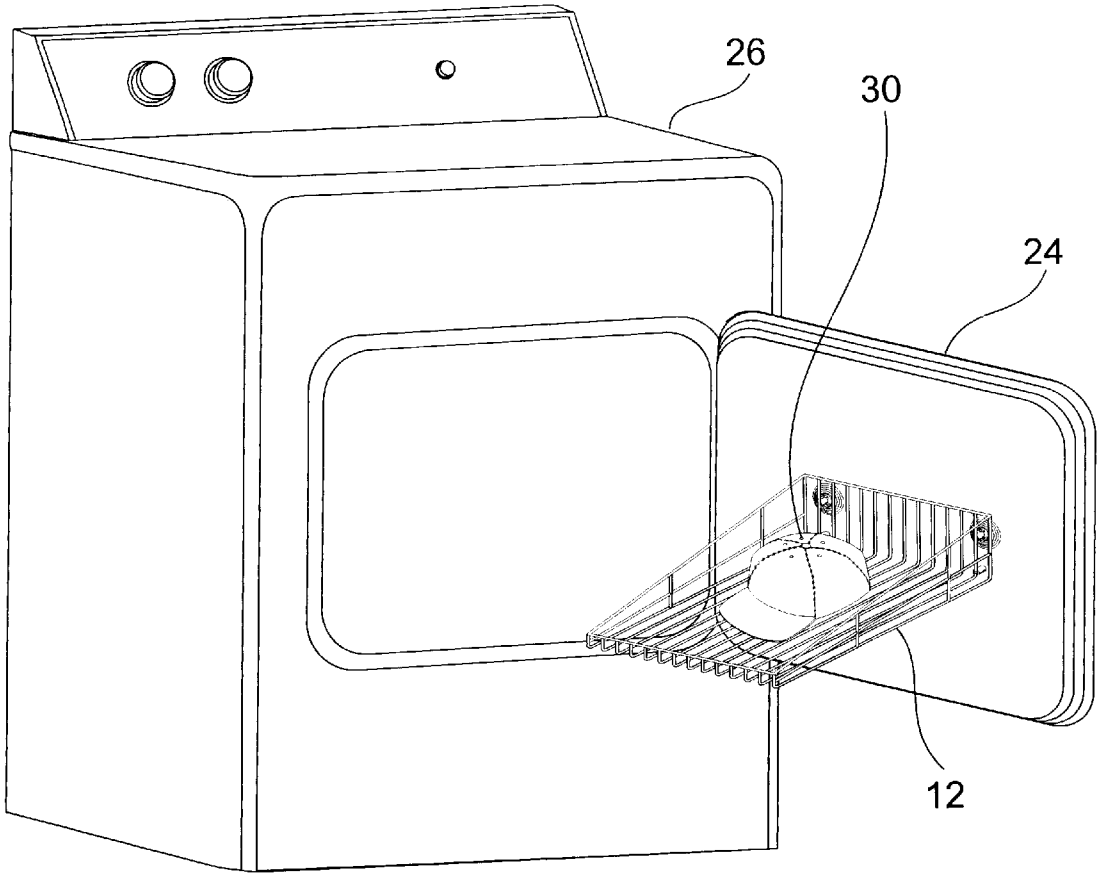
FIG. 4 is a perspective view of the present invention illustrated in use.

A second embodiment of the present invention is shown in FIG. 3 and includes substantially all of the components of the present invention wherein the suction cups 22 are replaced by magnets 28 that will allow the rack portion 12 to be secured to the dryer door 24.

In use, the rack portion 12 will be secured the dryer door 24 to support items, such as sneakers and hats 30 thereon. The rack portion 12 will allow these items to be held thereon when the dryer is activated. Thus, the items will not be tossed about within the dryer. This will eliminate the noise generally associated with heavy objects' freely placed in a dryer for drying. The present invention allows heavy items to remain stationary while the drum of the dryer is turning. When not in use, the rack portion 12 can be easily removed from the dryer door 24 to allow normal operation of the dryer 26.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A drying rack attachable to a dryer door for allowing heavier objects to be dried within a clothing dryer without being tossed about within the clothing dryer comprising, in combination:

a rack portion including a lower wall having a forward end, a rearward end, and opposed sides, the forward end having a short lip extending upwardly therefrom, the rearward end having a back wall extending upwardly therefrom, the back wall having a height at least two times greater than a height of the short lip, the opposed sides having triangular side walls extending upwardly therefrom between the back wall and the short lip;

a pair of suction cups secured to the back wall of the rack portion, the pair of suction cups allowing the rack portion to be removably coupled with an interior surface of a dryer door of a clothing dryer whereby the lower wall of the rack portion is orthogonally disposed with respect to the dryer door; and a pair of support stoppers secured to the back wall of the rack portion disposed below the pair of suction cups, the pair of support stoppers serving to facilitate support of the rack portion with respect to the dryer door.

2. A drying rack attachable to a dryer door for allowing heavier objects to be dried within a clothing dryer without being tossed about within the clothing dryer comprising, in combination:

a rack portion, the rack portion having a lower wall, the lower wall having a forward end, a rearward end, and opposed sides, the forward end having a short lip extending upwardly therefrom, the rearward end having a back wall extending upwardly therefrom, the back wall having a height at least two times greater than a height of the short lip, the opposed sides having triangular side walls extending upwardly therefrom between the back wall and the short lip;

securement means secured to the rack portion, the securement means allowing the rack portion to be removably coupled with an interior surface of a dryer door of a clothes dryer whereby the rack portion is orthogonally disposed with respect to the dryer door; and a pair of support stoppers secured to the rack portion disposed below the securement means, the pair of support stoppers serving to facilitate support of the rack portion with respect to the dryer door.

3. The drying rack attachable to a dryer door as set forth in claim 2, wherein the securement means comprising at least one suction cup.

4. The drying rack attachable to a dryer door as set forth in claim 2, wherein the securement means comprising at least one magnet.

* * * * *